United States Patent [19]

Tepper

[11] Patent Number: 4,763,895

[45] Date of Patent: Aug. 16, 1988

[54] SQUIRTING PLAYSEAT

[75] Inventor: Sidney Tepper, Milburn, N.J.

[73] Assignee: Gerber Products Company, Fremont, Mich.

[21] Appl. No.: 916,245

[22] Filed: Oct. 7, 1986

[51] Int. Cl.[4] ..... A63G 17/00

[52] U.S. Cl. ..... 272/52; 272/1 B; 272/52.5

[58] Field of Search ..... 272/52, 1 B, 27 W, 27 N, 272/53.2; 446/29, 74, 153, 156, 199, 176, 180, 193, 197, 198, 154, 89, 313, 353; 239/211; 221/24; 222/78; 273/349

[56] References Cited

U.S. PATENT DOCUMENTS

| | | | |
|---|---|---|---|
| 137,896 | 4/1873 | Crandall | 272/53.2 |
| 928,139 | 7/1907 | Lippstadt | 222/78 |
| 1,372,351 | 3/1921 | Hurlstone-Jones | 272/53.2 |
| 1,462,041 | 7/1923 | Meyer | 239/211 |
| 1,524,802 | 2/1925 | Slater | 239/211 |
| 1,660,085 | 2/1928 | Nassau | 239/211 |
| 1,767,911 | 6/1930 | Berko et al. | 239/211 |
| 2,173,691 | 9/1939 | Marlowe | 272/53.2 |
| 3,217,928 | 11/1965 | Burdig | 222/78 |
| 3,248,741 | 5/1966 | Stout et al. | 222/78 |
| 3,820,715 | 6/1974 | Hamilton | 239/211 |
| 4,223,894 | 9/1980 | Fabricant | 222/78 |

*Primary Examiner*—Robert A. Hafer
*Assistant Examiner*—Samuel Rimell
*Attorney, Agent, or Firm*—Townsend and Townsend

[57] ABSTRACT

A child's playseat used for partial submersion in a bathtub or pool is provided with a mechanism for squirting water as the seat is rocked back and forth. The playseat itself consists of a seat portion which slides back and forth over a fixed base, with a bellows lodged between them for expansion and contraction as the seat slides. Preferred embodiments include an upright post with handlebars, the post pivotally mounted to the playseat to cause the seat to slide when the handlebars are pushed and pulled. Water ejected upon contraction of the bellows passes up through a tube which emerges from the post.

9 Claims, 4 Drawing Sheets

SQUIRTING PLAYSEAT

BACKGROUND AND SUMMARY OF THE INVENTION

This invention relates to toys, and particularly to toys for use in water such as in a bathtub or shallow pool.

This invention resides in the structure of a playseat for use by a child while partially immersed in water, generally to a depth of no more than a few inches. The playseat is similar to a hobbyhorse and consists of a seat which slides back and forth over a fixed base, so that the child may rock back and forth in the seat for its amusement. The focus of the present invention is a squirting mechanism in the construction of the playseat, which draws water from the body of water in which the playseat is placed, and forces it through a tube and out an ejection port placed at a decorative or amusing location on the seat as the child slides back and forth. In preferred embodiments, the apparatus has an upright post in front, pivotally mounted to the seat and/or base, preferably both, so that rocking the post back and forth causes the seat to slide. Other preferred embodiments incorporate various other features as disclosed below.

The invention is particularly useful in enhancing the child's amusement during the otherwise unpleasant ritual of taking a bath, or adding enjoyment to already enjoyable activities such as splashing in a pool. Potentially dangerous parts are shielded from the child's access, and operation of the mechanism is achieved while the child is securely placed in the seat, maximizing enjoyment while minimizing the risk of a mishap.

DETAILED DESCRIPTION OF THE INVENTION

Figure 1:
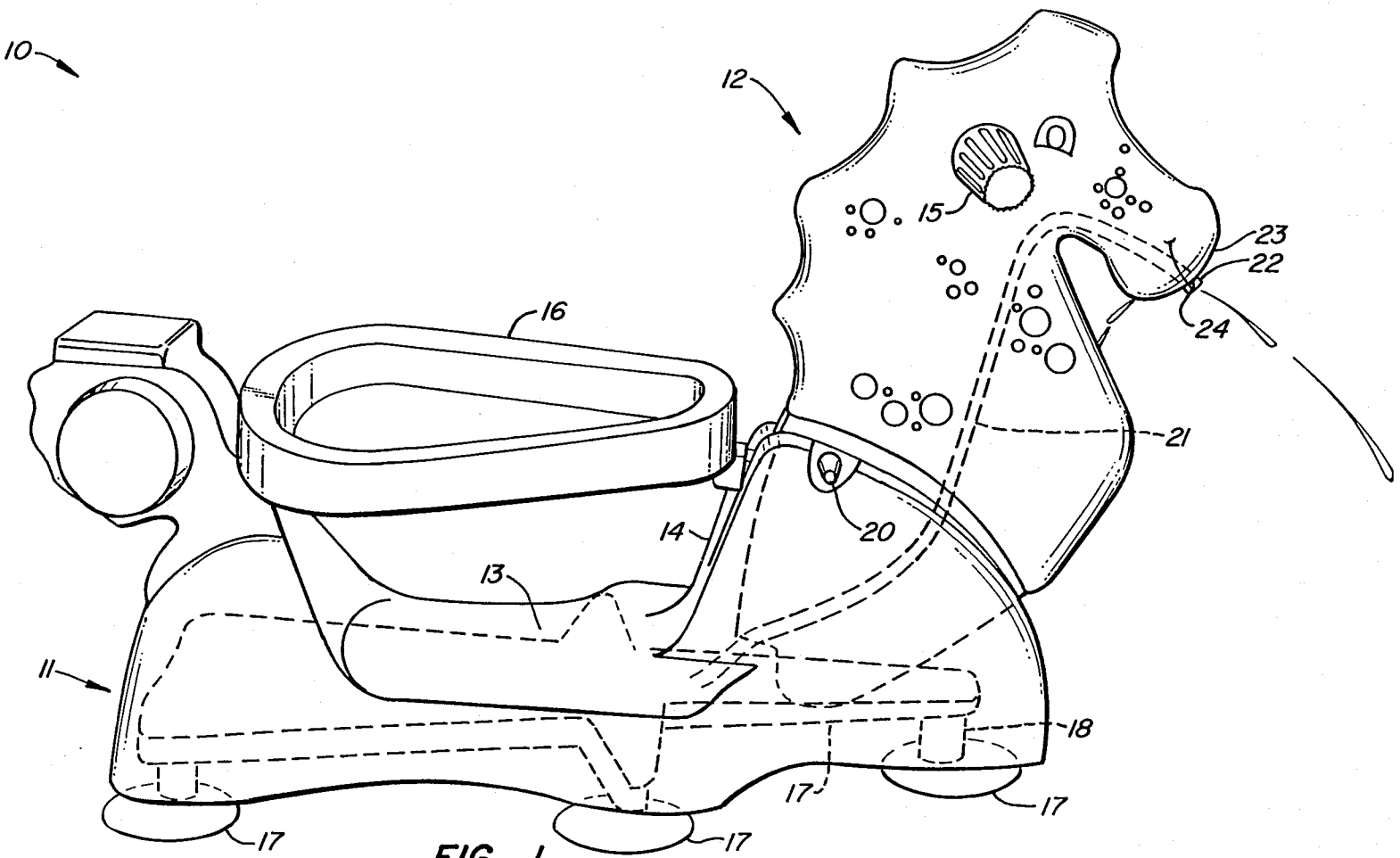
FIG. 1 is a perspective view of an illustrative embodiment of a child's playseat in which the features of the present invention may be incorporated.

The playseat 10 of FIG. 1 has the form of a seahorse for the child's amusement while sitting in a shallow pool of water. The two major visible parts are the seat portion 11 and the handle portion 12, the latter being in the shape of a seahorse head. The actual seat 13 is a horizontal surface on which the child's buttocks are placed, with the front part 14 of the seat and the handle 12 forming an upright post which the child faces while sitting in the seat. The child's legs go on either side of the post. The child's hands grasp each of a pair of knobs 15 protruding from the handle portion 12 on either side thereof. Only one such knob is shown in the drawing, the other being symmetrically placed on the opposite side. A removable retaining ring 16 loosely encircles the child's torso to help keep the child in position while on the playseat, thereby minimizing the danger of slipping into the water.

The playseat is intended for placement on the floor of a tub or pool, and accordingly contains suction cups 17 to secure it to the surface in a nonslipping manner. In this particular embodiment, the suction cups are affixed to feet 18 which extend downward from a support base 19 located inside the seat portion 11 of the seahorse. The support base 19 and feet 18 are completely covered by the seat portion 11 and are thus not visible in the view shown in FIG. 1. While dash lines are used to shown their location in FIG. 1, they are shown in detail in FIG. 3, discussed below.

Still referring to FIG. 1, the handle 12 (seahorse head) is pivotally mounted to the seat portion 11. In this particular illustration, the pivot fulcrum is a pin 20 passing through the upright front part 14 of the seat portion 11. Also shown in dashed lines is a water tube 21 passing through the interior of the playseat, extending from the underside of the seat portion 11 up through the handle portion 12 (the neck and head of the seahorse), terminating in a tip 22 emerging through a hole in the seahorse snout 23. A pair of holes 24 in the emerging tip 22 direct the water out in two directions as it is forced through the tube 21. Due to the perspective of the drawing, only one such hole is visible, although the water streams from both holes are shown. The present invention is not intended to be limited to the particular arrangement of tube 21, emerging tip 22 and holes 24 shown in this drawing. The location of the emerging tip may be anywhere on the exterior of the playseat, either seat portion or handle portion. The preference will depend on the particular design and shape of the playseat, which vary widely to resemble any of numerous animals or structures.

Figure 2:
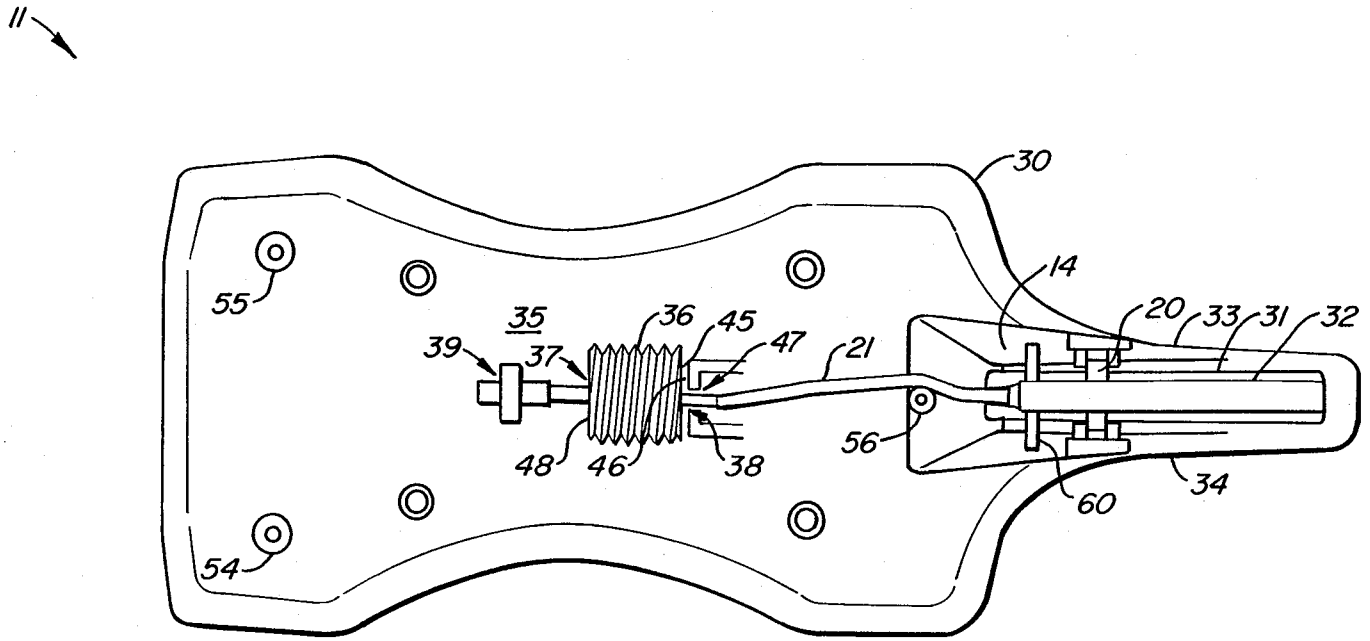
FIG. 2 is a plan view of the seat portion and part of the handle portion of the embodiment of FIG. 1 viewed from underneath.

FIG. 2 shows the seat portion 11 in detail, as viewed from underneath. In this embodiment, the seat portion 11 is designed to cooperate with the support base 19 shown in FIG. 3. The shell 30 of the seat portion opens at a slot 31 along the upper surface of the raised front part 14. Passing through the slot is a tongue 32 which is a downward extension of the handle portion 12 of the playseat. The pivot pin 20 passes through this tongue 32 as well as the side walls 33, 34 of the upright front part 14 of the seat portion. The water tube 21 is shown emerging from the tongue 32 to the underside 35 of the seat portion, where it terminates in a flow-through bellows 36.

The term "flow-through bellows" is used herein to distinguish this element from bellows which have only one port serving for both intake and exhaust. The flow-through bellows of the present invention has two ports, an intake port 37 and an outlet port 38 so that water may be drawn in at one end and discharged out the other. A check valve 39 is installed at the inlet end, to assure that water flowing through the intake port 37 flows in one direction only, into the bellows 36 (i.e., to the right in the view shown in the drawing).

The flow-through bellows 36 has a flat face 45 at its outlet end. This face is positioned against a surface 46 projecting from the underside 35 of the seat portion. A passage 47 through the surface permits the tube 21 to pass. Ejection of water from the bellows 36 into the water tube 21 and eventually out the tip 22 (FIG. 1) is achieved when the bellows is compressed against the surface 46. Compression of the bellows is achieved by pressure on the flat face 48 at the inlet end of the bellows. It will be seen from the description of FIG. 3 which follows that the pivoting of the handle 32 around the pivot pin 20 causes the entire seat portion 11 to slide with respect to the support base 19 and that such sliding motion causes studs (described below) projecting from the support base to push the inlet face 48 of the bellows toward the right, compressing the bellows.

Figure 3:
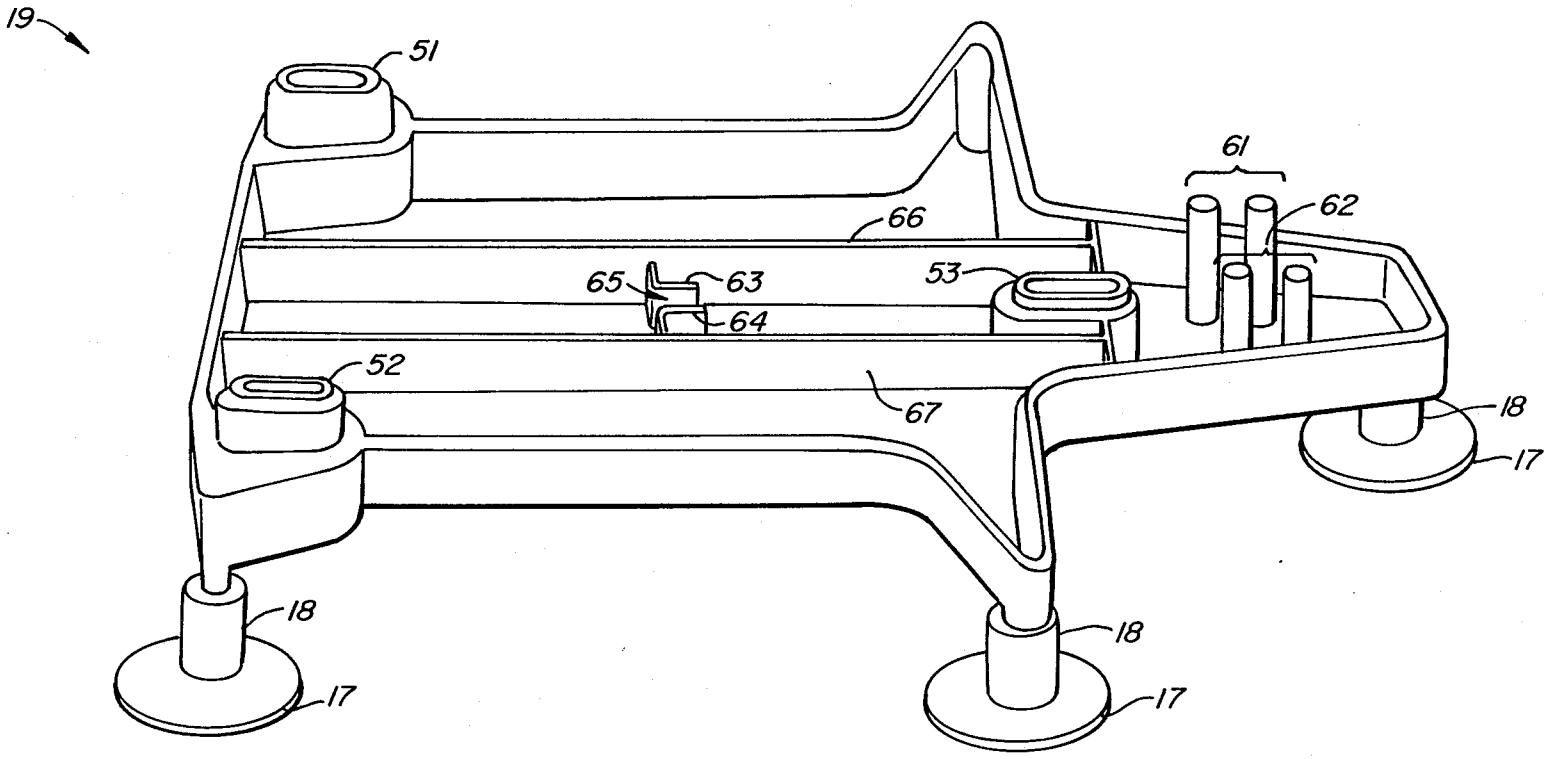
FIG. 3 is a perspective view of a support base forming part of the structure of the embodiment shown in FIG. 1. The seat portion shown in FIG. 2 fits over this support base, covering it entirely except for the feet when the parts are assembled.

Turning now to the support base 19 depicted in FIG. 3, the sliding connections between the support base and the seat shell 30 can be seen. These sliding connections are comprised of three upwardly projecting slots 51, 52, 53 for the passage of bolts (not shown) which are secured to threaded bolt holes 54, 55, 56, respectively, shown in FIG. 2. Bolts (not shown) are conveniently screwed in from underneath, through washers (also not shown) placed underneath the slots 51, 52, 53. The lengths of these slots defines the maximum range of travel of the seat shell 30 with respect to the support base 19.

The relative motion of the two parts is attributable to a pivot connection between the handle portion 12 (seahorse head) and the support base 19. This pivot connection consists of a pin 60 (FIG. 2) passing transversely through the tongue 32 which forms the lower end of the handle portion 12, and two pairs of upright posts 61, 62 projecting upward from the support base 19 (FIG. 3). The pivot pin 60 passes between each pair of posts. Accordingly, when the handle portion 12 is rocked backward and forward, both pivot connections pivot and the seat shell 30 is forced to slide backward and forward with respect to the support base 19.

The studs referred to above which force compression of the flow-through bellows 36 are shown in FIG. 3. These studs 63, 64 are projections in the support base 19, and when the parts are assembled, the studs contact the inlet end face 48 of the bellows 36. The bellows is thereby compressed between the studs and the surface 46 projecting from the underside 35 of the seat, and contraction of the bellows is achieved when the parts are moved relative to each other. An opening 65 between the studs permits passage of tubing leading to the intake port 37 of the bellows. The check valve 39 rests behind (to the left of, in view shown in the drawing) the studs when the parts are assembled.

In the embodiment shown in the drawings, the support base 19 further contains a pair of parallel ribs 66, 67 which define a chamber for the bellows 36, ensuring its proper placement and alignment.

Figure 4:
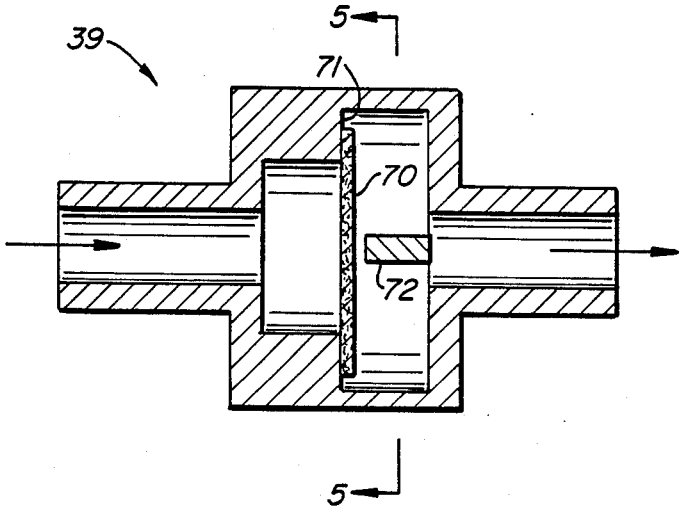
FIGS. 4 and 5 are sectional views of a generally cylindrical check valve shown along an axial plane and a transverse plane, respectively. This check valve forms part of the squirting mechanism shown in FIG. 2.
Figure 5:
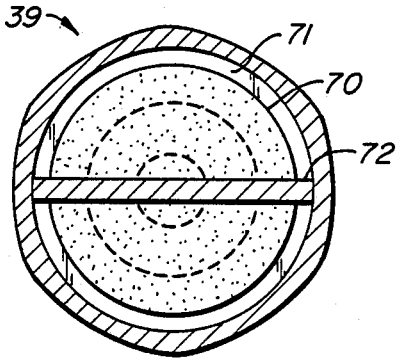

The check valve 39 shown in FIG. 2 may assume any of a variety of forms known to those skilled in the art. One example of such a valve is shown in the sectional views in FIGS. 4 and 5. At the center of the valve is a flexible membrane 70 which seats against a shoulder 71 in its normal position. When a pressure differential is imposed across the membrane, in which the pressure at the left side of the membrane (in the FIG. 4 view) is higher, the membrane 70 will deform, its upper and lower parts bending to the right over a transverse rib 72 which spans the opening. The membrane is thus displaced from the shoulder 71, permitting fluid flow around and past it. With a pressure differential in the opposite direction, the membrane 70 is forced against the shoulder 71, stopping flow. Flow is therefore permitted only in the direction of the arrows 73, 74. The elements of the check valve are further illustrated in FIG. 5, which is a view taken along the lines 5—5 of FIG. 4.

In further preferred embodiments, the seat portion of the playseat is spring-biased toward a position in which the studs 63, 64 (FIG. 3) are retracted from the compression surface 46 (FIG. 2) and the bellows is thereby expanded. This may be achieved by incorporating a spring into the structure, or by merely using a bellows having its own elastic or resilient properties, i.e., one which will return to its expanded shape when relieved of external pressure.

The foregoing description is offered primarily for purpose of illustration. It will be readily apparent to those skilled in the art that numerous variations, modifications and substitutions of the elements and features of construction and operation disclosed above may be made without departing from the spirit and scope of the invention.

What is claimed is:

1. A squirting playseat adapted to be partially submerged in a body of water, said playseat comprising;

a base;

a seat slidably mounted to said base for linear sliding motion with respect thereto;

bellows located between said base and said seat;

means projecting from said base and said seat for retaining said bellows below the water level said means abutting said bellows to effect contraction and expansion of said bellows as the result of said seat sliding back and forth; means projecting from said bellows for squirting water from said playseat.

2. A squirting playseat in accordance with claim 1 further comprising a tube extending from a discharge port on said bellows to a point on said playseat above said water level.

3. A squirting playseat in accordance with claim 1 in which said bellows are flow-through bellows having an intake port and a discharge port, and said squirting playseat further comprises a tube extending from said discharge port to above said water level.

4. A squirting playseat in accordance with claim 1 in which said bellows are flow-through bellows having an intake port and a discharge port, and said squirting playseat further comprises a tube extending from said discharge port to above said water level and a check valve on said intake port preventing fluid flow away from said bellows at said intake port.

5. A squirting playseat in accordance with claim 1 further comprising a handle extending upward from said seat and pivotally connected to both said base and said seat such that pivoting of said handle causes said seat to slide over said base.

6. A squirting playseat in accordance with claim 1 in which said seat is resiliently biased with respect to said based toward a position in which said bellows are expanded.

7. A squirting playseat in accordance with claim 1 in which said bellows are resiliently biased toward an expanded position.

8. A squirting playseat in accordance with claim 1 further comprising a handle extending upward from said seat, and a tube extending from a discharge port on said bellows up through the interior of said handle to emerge therefrom at a location above the water level.

9. A squirting playseat comprising:

a support base adapted to be secured to the floor of a water containing vessel;

a seat slidably mounted to said support base for linear sliding motion with respect thereto;

a handle pivotally mounted to the front of said seat and pivotally mounted to said support base;

a tube having a discharge and emerging from said handle, said tube extending through the interior of said handle toward an intake end located below said seat;

flow-through bellows at said intake end of said tube, said flow-through bellows lodged between a member projecting downward from the underside of said seat and a member projecting upward from said support base; and a check valve at an intake port in said flow-through bellows to prevent fluid flow out of said flow-through bellows through said intake port.

* * * * *